United States Patent [19]

Cuir et al.

[11] Patent Number: 4,561,355

[45] Date of Patent: Dec. 31, 1985

[54] DEVICE FOR FIXING A PLATE ON A CYLINDER

[76] Inventors: Jean P. Cuir, 36 Av de Brigode; Gérard Cuir, 23 Allée des Champs, both of 59650 Villeneuve D'ASCQ, France

[21] Appl. No.: 706,894

[22] Filed: Feb. 28, 1985

Related U.S. Application Data

[63] Continuation of Ser. No. 496,582, May 20, 1983, abandoned.

[30] Foreign Application Priority Data

May 27, 1982 [FR] France ..... 82 09702

[51] Int. Cl.[4] ..... B41F 27/06

[52] U.S. Cl. ..... 101/378; 101/382 MV; 101/401.3; 83/698

[58] Field of Search ..... 101/91, 92, 375, 378, 101/382 R, 382 MV, 401.3, 415.1; 33/184.5; 269/21; 83/698, 699

[56] References Cited

U.S. PATENT DOCUMENTS

| | | | |
|---|---|---|---|
| 1,041,028 | 10/1912 | Church | 269/21 X |
| 1,358,843 | 11/1920 | Grass | 101/378 X |
| 2,060,082 | 11/1936 | Johnson et al. | 101/378 |
| 2,285,116 | 6/1942 | Grupe | 101/378 |
| 2,355,529 | 8/1944 | Hawley | 101/401.3 |
| 2,443,987 | 6/1948 | Morrison et al. | 269/21 |
| 3,129,662 | 4/1964 | Pinkerton | 101/91 X |
| 4,328,749 | 5/1982 | Irouye et al. | 101/92 X |

OTHER PUBLICATIONS

Hydraulics–FOS Fundementals of Service Deere & Co. Moline, Ill. 3rd Ed. 1979, pp. 3–6, 3–7.

*Primary Examiner*—Edgar S. Burr
*Assistant Examiner*—Charles A. Pearson
*Attorney, Agent, or Firm*—Kerkam, Stowell, Kondracki & Clarke

[57] ABSTRACT

The invention relates to a device for fixing a plate on a cylinder, while permitting to quickly control, at certain instants, the application and fixation of this plate on a particular angular portion of this cylinder and, at other instants, the disengagement of this plate.

It is characterized by the fact that, in addition to means (9) enabling the plate (3) to be brought against the cylinder or, on the contrary, separating it from its area of support, it comprises means (10) for fully applying on the cylinder both the median portion and the ends of the plate.

Application to the mechanical construction industry and, more particularly, to rotary printing and cutting machines.

11 Claims, 2 Drawing Figures

DEVICE FOR FIXING A PLATE ON A CYLINDER

This is a continuation of application Ser. No. 496,582, filed on May 20, 1983, now abandoned.

The invention relates to a device for fixing a plate on a cylinder while permitting to quickly control, at certain instants, the application and fixation of said plate on a particular angular portion of said cylinder and, at other instants, the rapid disengagment of said plate.

It also relates to the machine that comprises at least one cylinder provided with at least one such device.

It relates more particularly, but not exclusively, to rotary machines for printing and cutting on the cylinders of said machines. A tool, such as a printing plate or the printing or cutting counterpart, can be fixed and fully applied on the cylinder during operation. The plate or tool can also be quickly disengaged from the cylinder area upon which it bears to permit access to said area and provide the time needed to slide thereon wedges. The wedges are capable of mitigating certain defects of the tool or of the counterpart.

With prior devices, the plate is kept on the cylinder by mechanical tensioning means such as flanges, or magnetic means.

Apart from the fact that the action of such prior art devices on the plate ends tends to arch the plate, the devices do not guarantee full application or contact along the median portion of the plate. Most disadvantageously, in order to permit access beneath the plate, it is necessary to dismantle the flanging, which is time-consuming, then bringing to another location the plate whose weight might be considerable.

One object of the invention is to provide a device which ensures both a perfect application of the plate on the cylinder and a quick disengagement of the plate in order to free the cylinder.

To this end, the invention aims at creating a device of the above mentioned type which is characterized by the fact that in addition to means for bringing the plate against the cylinder or, on the contrary, to separate it from its area of support, it comprises means for perfectly applying both the median portion as well as the ends of the plate on the cylinder.

Figure 1:
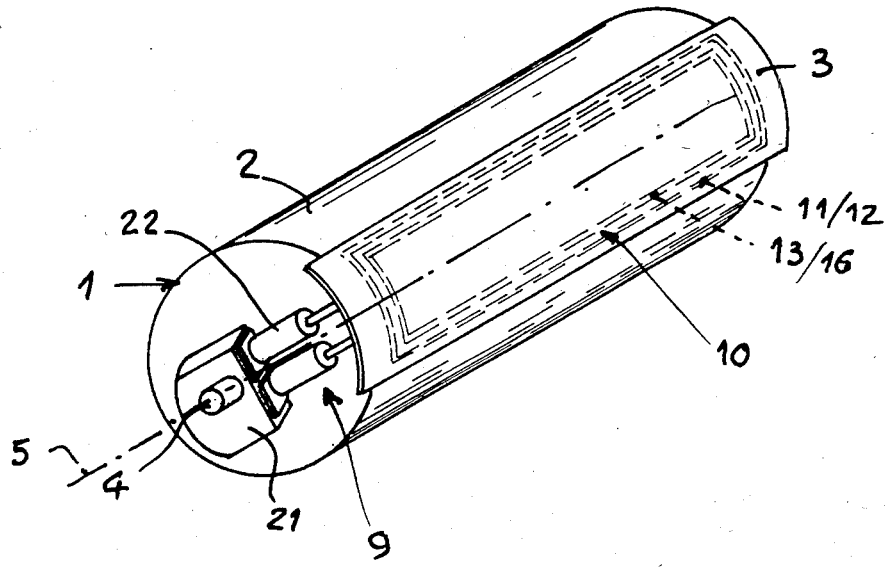
Figure 2:
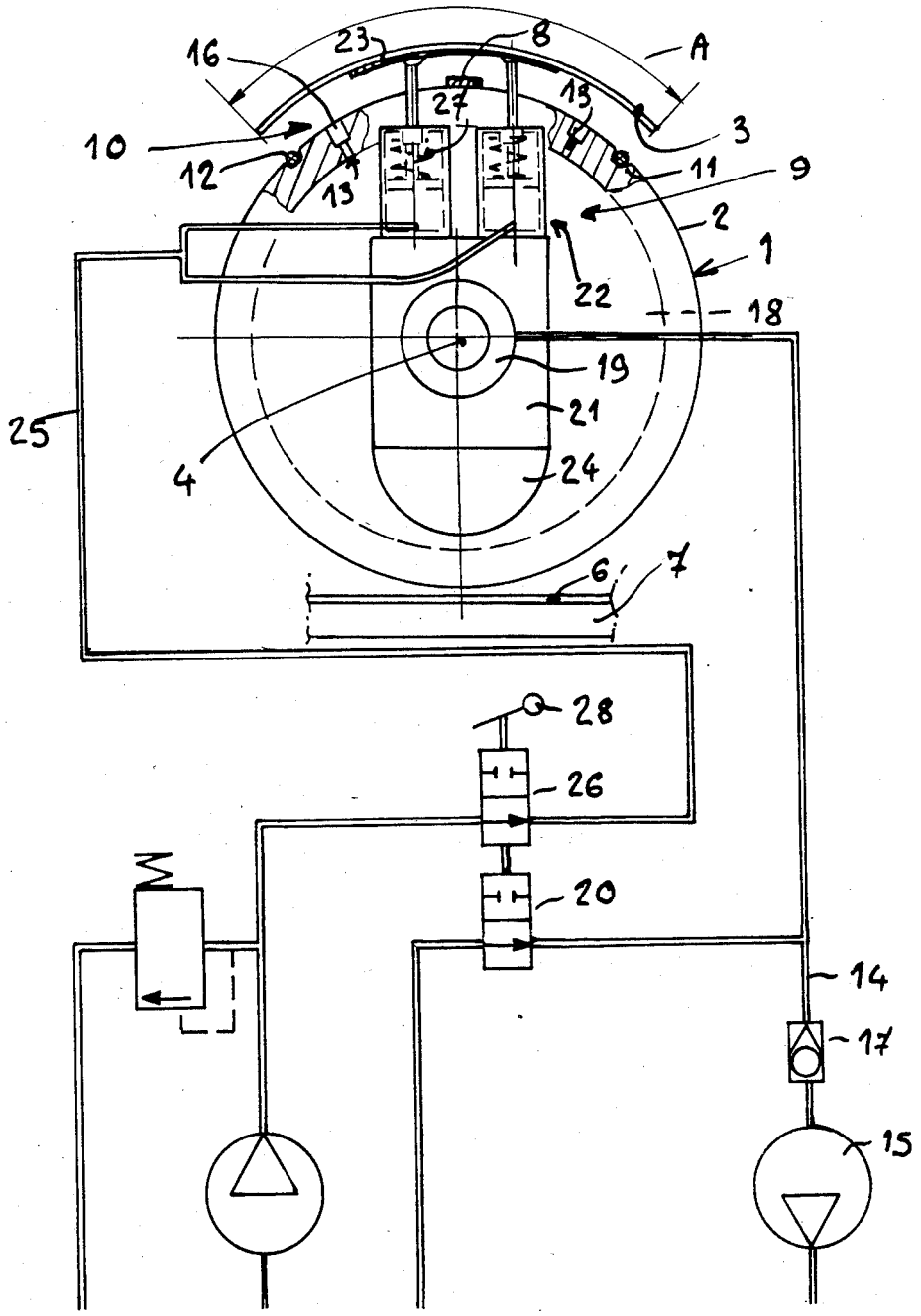

The invention will be better understood from the consideration of the ensuing description offered by way of non-limitative example and from the attached drawings, which show schematically in:

FIG. 1 the cylinder and the device in a perspective view;

FIG. 2 the cylinder and the device in a cross-sectional view and on a larger scale.

Now, referring to the drawings, the machine has a cylinder 1 on an angular portion "A" of the lateral or cylindrically curved surface 2 of which, during the operation, a plate 3, such as a printing plate, must be perfectly applied and forcibly fixed.

This cylinder 1 is provided with two pins or shaft ends 4 by which it is guided and driven into rotation about its axis 5 by any means of known construction (not shown). It cooperates with a form 6 carried by another cylinder or a surface plate 7.

Since the plates are rarely perfect and the slightest defect in the plate thickness is translated into a defect in the piece of work produced, alterations must often be carried out and, for this purpose, it is necessary to place wedges 8 beneath the plate, fixing them directly on the face 2 of the cylinder 1 or on an intermediate foil.

According to a main characteristic of the invention, in addition to the means 9 for engaging and disengaging the plate 3, the plate-fixing device has means 10 for fully applying on the cylinder 1 both the median portion and the ends of the plate.

These application means 10 comprises within the support surface of the plate on the cylinder, on one side throughout the length of the edges of said surface, a groove 11 which accommodates a seal 12 and, on the other side, a short distance therefrom, orifices 13 connected to a suction circuit 14 of a vacuum pump 15.

The pressure differential between the internal face of the plate subjected to the pump action and the external face subjected to atmospheric pressure forcibly applies the plate on the cylinder.

To better distribute the action of the depression, the orifices 13 preferably run into a peripheral groove 16.

To prevent inadvertent entry of air after a stoppage of the pump, if only after a circuit break, a check valve 17 is placed on the circuit 14.

The grooves 11 and 16 can both be supported by the plate or distributed one on the plate and the other on the cylinder, but preferably they are on the cylinder 1 which is hollow as shown. Inserted between the orifices 13 and the circuit 14 is the cavity 18 of the cylinder 1 being used as a vacuum chamber to help hold the plate 3 down especially in the event of a stoppage of the vacuum pump 15 mentioned above.

To this end, the orifices 13 run into the cavity 18 to which the circuit 14 is connected by means of a rotary seal 19.

Between the check valve 17 and the chamber 18, the circuit 18 is connected to a directional control valve 20 which enables the chamber 18 to discharge into the atmosphere in order to disengage the plate.

To make certain that the action of the vacuum pump 15 results in a perfect application of the plate 3 on the cylinder 1, it stands to reason that the plate 3 must first be brought sufficiently close to the cylinder, enabling seal 12 to insulate the volume located beneath the plate 3 from the atmospheric pressure.

This device for bringing the plate 3 against the cylinder 1 may consist of a conventional plate-fixing device, but in a preferred embodiment and according to a main feature of the invention, this device 9 is composed of two hubs 21, each of which is engaged on one of the shaft ends 4 of the cylinder 1, about whose axis 5 said hubs 21 are free to oscillate at least over an angular range and there is connected to each of these hubs 21 through at least one arm 22 of adjustable length a support, such as a flange 23, which is capable of seizing one end of the plate 3 through a means of known construction. Thus, there is one support flange 23 at each end. On the side opposite to the supports 23, the hubs 21 advantageously carry counterweights 24 which, when the plate is separated from the cylinder 1 by the extension of the arms 3, balance the weight of the assembly formed by the arms, the supports, and the plate 3.

Therefore, after the plate has been separated, no effort whatsoever will be required, either manually or via mechanical means, to cause this assembly to oscillate about the axis 5 of the cylinder 1, thus enabling the plate 3 to separate from its area of support on the cylinder 1 in order, for example, to make improvements thereon.

On a preferred embodiment, the adjustable arms 22 consist of cylinders that are supplied with pressurized fluid through a circuit 25 controlled by a directional control valve 26.

According to one feature of the invention, each arm 22, composed of a lift cylinder with single or double action, has an elastic element 27, such as a spring, which continuously pulls the support and, thereby, the plate, to the cylinder 1 so that even in case of a cut-off in the fluid supply of the lift cylinders 22 the plate will be applied on the cylinder to enable the machine to be used, the fluid then being only indispensable for the separation of the plate.

According to another feature of the invention, the directional control valve 26 placed on the control circuit 25 of the adjustable arms 22 and the directional control valve 20 connected to the circuit 14 of the vacuum pump are connected through means, such as a common lever 28, to ensure the coexistence of:

the putting under atmospheric pressure of the plate (3) bottom and the pressurization of the lift cylinders for the separation of this plate, as well as the expulsion of the control fluid of the lift cylinder 22 that separate the plate from the cylinder such that the elastic elements will act on the cylinders and the application of suction to the plate bottom as caused by pump 15.

We claim:

1. A device for mounting a plate (3) on a cylinder (11), said device permitting the quick application and fixation of said plate (3) on a particular angular portion of said cylinder and, said device also permitting the disengagement of said plate from the cylinder (1), said device comprising two shaft ends (4) by which said cylinder (1) is guided and driven into rotation about an axis (5), said device including positioning means (9) operable to move the plate (3) toward the cylinder (1) and away from the cylinder (1), said positioning means comprising two hubs (21), each hub being mounted on one of the shaft ends (4) of the cylinder (1) and being free to rotate at least over an angular range relative to the cylinder, and at least one flange support (23) connected on one side to at least one of said hubs (21), through at least one arm (22) of adjustable length for securing one end of the plate (3), said device also including means (10) for fully applying on the cylinder both the median portion and the ends of the plate, said means for applying including a hollow cavity (18) within said cylinder forming a chamber disposed between orifices (13) formed in the cylinder and a circuit (14) of a vacuum pump (15), said circuit being equipped with a check valve (17) and connected to a directional control valve (20) which enables said circuit to discharge into the atmosphere.

2. The device according to claim 1, characterized in that said application means (10) is bounded by the part of a surface of the cylinder which the plate is brought against and includes, throughout the length of edges of said plate, a groove (11) which accommodates a seal (12) and, said orifices are a short distance from said seal, and said orifices are within said seal.

3. The device according to claim 2 further comprising a plurality of like-constructed arms and a plurality of like-constructed flange supports and wherein on a side opposite to the flange supports (23), the hubs (21) include counterweights (24) which, when the plate (3) is positioned away from the cylinder surface, balance the weight of the assembly formed by the arms (22), the flange supports (23) and said plate (3).

4. The device according to claim 2 wherein the arm (22) comprises a lift cylinder supplied with pressurized fluid through a circuit (25) controlled by a directional control valve (20).

5. The device according to claim 4 wherein said lift cylinder has an elastic element (27) which continuously pulls the support and, thus, the plate toward the cylinder.

6. The device according to claim 4 wherein the directional control valve (26) connected in the control circuit (25) of the adjustable arm (22) and the directional control valve (20) connected to the circuit (15) of the vacuum pump are connected by means (28) for ensuring the coexistence of:

the placing under atmospheric pressure of the plate bottom and the pressurization of the lift cylinder for the separation of the plate, as well as the expulsion of the control fluid of the lift cylinder that separate the plate and of the application of suction to the plate bottom.

7. The device according to claim 1 wherein on a side opposite to the flange support (23), the hubs (21) include counterweights (24) which, when the plate (3) is positioned away from the cylinder surface (22), balance the weight of the assembly formed by the arms, the flange supports (23) and said plate (3).

8. The device according to claim 1 wherein the arms (22) comprise cylinders supplied with pressurized fluid through a circuit (25) controlled by a directional control valve.

9. Apparatus comprising a printing plate (3) fixable to an angular support zone portion (A) of a cylindrically curved surface (2) of a printing cylinder (1), wherein said support zone portion has holes (13) which are connected via a circuit (14) with a vacuum pump (15) and operatable to apply suction to the printing plate to press the printing plate securely upon the support zone portion, said cylinder being guided in rotation about its axis (5) by two shaft ends (4) provided on opposite ends of said cylinder, and further comprising:

two hubs (21) each engaging one of the shaft ends (4) and which are free to rotate about the axis (5) of the cylinder, both with respect to the shaft ends (4) and with respect to the cylindrically curved surface (2) of the cylinder;

two arms of variable length (22), each having a first end connected to one of the hubs (21); said arms (22) being operable to move the plate around and toward and away from said cylinder (1), a plate support (23) attached to a second end of each arm (22) and comprising means for removably securing the plate at said support, and means for controlling the variation in the length of the arms (22) both in the direction where they press the plate (3) against the support zone portion and in a direction where they separate the plate (3) from the support zone portion.

10. Apparatus as defined by claim 9 further comprising a groove (11) which accommodates a sealing ring (12) provided along the edges of the support zone portion and wherein the bores (13) are distributed along the seal (12) and discharge into a peripheral groove (16).

11. Apparatus as defined by claim 9, wherein the means for controlling the variation in the length of the arms (22) include springs (27) which are operable to press the plate against said support zone portion.

* * * * *